US007613603B2

(12) United States Patent
Yamashita

(10) Patent No.: US 7,613,603 B2
(45) Date of Patent: Nov. 3, 2009

(54) AUDIO CODING DEVICE WITH FAST ALGORITHM FOR DETERMINING QUANTIZATION STEP SIZES BASED ON PSYCHO-ACOUSTIC MODEL

(75) Inventor: Hiroaki Yamashita, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 556 days.

(21) Appl. No.: 11/272,223

(22) Filed: Nov. 10, 2005

(65) Prior Publication Data

US 2006/0074693 A1 Apr. 6, 2006

Related U.S. Application Data

(63) Continuation of application No. PCT/JP03/08329, filed on Jun. 30, 2003.

(51) Int. Cl.
*G10L 19/00* (2006.01)

(52) U.S. Cl. ..... 704/200.1; 704/500; 704/501; 704/229; 704/230

(58) Field of Classification Search ..... 704/200.1, 704/230, 500, 501, 229
See application file for complete search history.

(56) References Cited

U.S. PATENT DOCUMENTS

| | | | | |
|---|---|---|---|---|
| 5,627,938 | A | 5/1997 | Johnston | |
| 6,778,953 | B1 * | 8/2004 | Edler et al. | 704/200.1 |
| 7,027,982 | B2 * | 4/2006 | Chen et al. | 704/230 |
| 7,062,445 | B2 * | 6/2006 | Kadatch | 704/500 |
| 2004/0002859 | A1 * | 1/2004 | Liu et al. | 704/229 |
| 2005/0175252 | A1 * | 8/2005 | Herre et al. | 382/251 |

FOREIGN PATENT DOCUMENTS

| | | |
|---|---|---|
| CA | 2090160 | 9/1993 |
| EP | 0 559 348 | 3/1992 |
| JP | 5-19797 | 1/1993 |
| JP | 6-51795 | 2/1994 |
| JP | 2000-347679 | 12/2000 |
| JP | 2002-026736 | 1/2002 |

OTHER PUBLICATIONS

International Search Report dated Aug. 5, 2003.

* cited by examiner

*Primary Examiner*—Qi Han
(74) *Attorney, Agent, or Firm*—Fujitsu Patent Center

(57) ABSTRACT

An efficient audio coding device that quantizes and encodes digital audio signals with a reduced amount of computation. A spatial transform unit subjects samples of a given audio signal to a spatial transform, thus obtaining transform coefficients of the signal. With a representative value selected out of the transform coefficients of each subband, a quantization step size calculator estimates quantization noise and calculates, in an approximative way, a quantization step size of each subband from the estimated quantization noise, as well as from a masking power threshold determined from a psycho-acoustic model of the human auditory system. A quantizer then quantizes the transform coefficients, based on the calculated quantization step sizes, thereby producing quantized values of those coefficients. The quantization step sizes are also used by a scalefactor calculator to calculate common and individual scalefactors. A coder encodes at least one of the quantized values, common scalefactor, and individual scalefactors.

13 Claims, 15 Drawing Sheets

AUDIO CODING DEVICE WITH FAST ALGORITHM FOR DETERMINING QUANTIZATION STEP SIZES BASED ON PSYCHO-ACOUSTIC MODEL

This application is a continuing application, filed under 35 U.S.C. §111(a), of International Application PCT/JP2003/008329, filed Jun. 30, 2003.

BACKGROUND OF THE INVENTION

1. Field of the Invention

The present invention relates to audio coding devices, and more particularly to an audio coding device that encodes audio signals to reduce the data size.

2. Description of the Related Art

Digital audio processing technology and its applications have become familiar to us since they are widely used today in various consumer products such as mobile communications devices and compact disc (CD) players. Digital audio signals are usually compressed with an enhanced coding algorithm for the purpose of efficient delivery and storage. Such audio compression algorithms are standardized as, for example, the Moving Picture Expert Group (MPEG) specifications.

Typical MPEG audio compression algorithms include MPEG1-Audio layer3 (MP3) and MPEG2-AAC (Advanced Audio Codec). MP3 is the layer-3 compression algorithm of the MPEG-1 audio standard, which is targeted to coding of monaural signals or two-channel stereo signals. MPEG-1 Audio is divided into three categories called "layers," the layer 3 being superior to the other layers (layer 1 and layer 2) in terms of sound qualities and data compression ratios that they provide. MP3 is a popular coding format for distribution of music files over the Internet.

MPEG2-AAC is an audio compression standard for multichannel signal coding. It has achieved both high audio qualities and high compression ratios while sacrificing compatibility with the existing MPEG-1 audio specifications. Besides being suitable for online distribution of music via mobile phone networks, MPEG2-AAC is a candidate technology for digital television broadcasting via satellite and terrestrial channels. MP3 and MPEG2-AAC algorithms are, however, similar in that both of them are designed to extract frames of a given pulse code modulation (PCM) signal, process them with spatial transform, quantize the resulting transform coefficients, and encode them into a bitstream.

To realize a high-quality coding with maximum data compression, the above MP3 and MPEG2-AAC coding algorithms calculate optimal quantization step sizes (scalefactors), taking into consideration the response of the human auditory system. However, the existing methods for this calculation require a considerable amount of computation. To improve the efficiency of coding without increasing the cost, the development of a new realtime encoder is desired.

One example of existing techniques is found in Japanese Unexamined Patent Publication No. 2000-347679, paragraph Nos. 0059 to 0085 and FIG. 1. According to the proposed audio coding technique, scheduling coefficients and quantization step sizes are changed until the amount of coded data falls within a specified limit while the resulting quantization distortion is acceptable. Another example is the technique disclosed in Japanese Unexamined Patent Publication No. 2000-347679. While attempting to reduce computational loads of audio coding, the disclosed technique takes an iterative approach, as in the above-mentioned existing technique, to achieve a desired code size. Because of a fair amount of time that it spends to reach the convergence of calculation, this technique is not the best for reduction of computational load.

SUMMARY OF THE INVENTION

In view of the foregoing, it is an object of the present invention to provide an audio coding device that can quantize transform coefficients with a reduced amount of computation while considering the characteristics human auditory system.

To accomplish the above object, the present invention provides an audio coding device for encoding an audio signal. This audio coding device comprises the following elements: (a) a spatial transform unit that subjects samples of a given audio signal to a spatial transform process, thereby producing transform coefficients grouped into a plurality of subbands according to frequency ranges thereof; (b) a quantization step size calculator that estimates quantization noise from a representative value selected out of the transform coefficients of each subband, and calculates in an approximative way a quantization step size for each subband from the estimated quantization noise, as well as from a masking power threshold that is determined from psycho-acoustic characteristics; (c) a quantizer that quantizes the transform coefficients, based on the calculated quantization step sizes, so as to produce quantized values of the transform coefficients; (d) a scalefactor calculator that calculates a common scalefactor and an individual scalefactor for each subband from the quantization step sizes, the common scalefactor serving as an offset applicable to an entire frame of the audio signal; and (e) a coder that encodes at least one of the quantized values, the common scalefactor, and the individual scalefactors.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
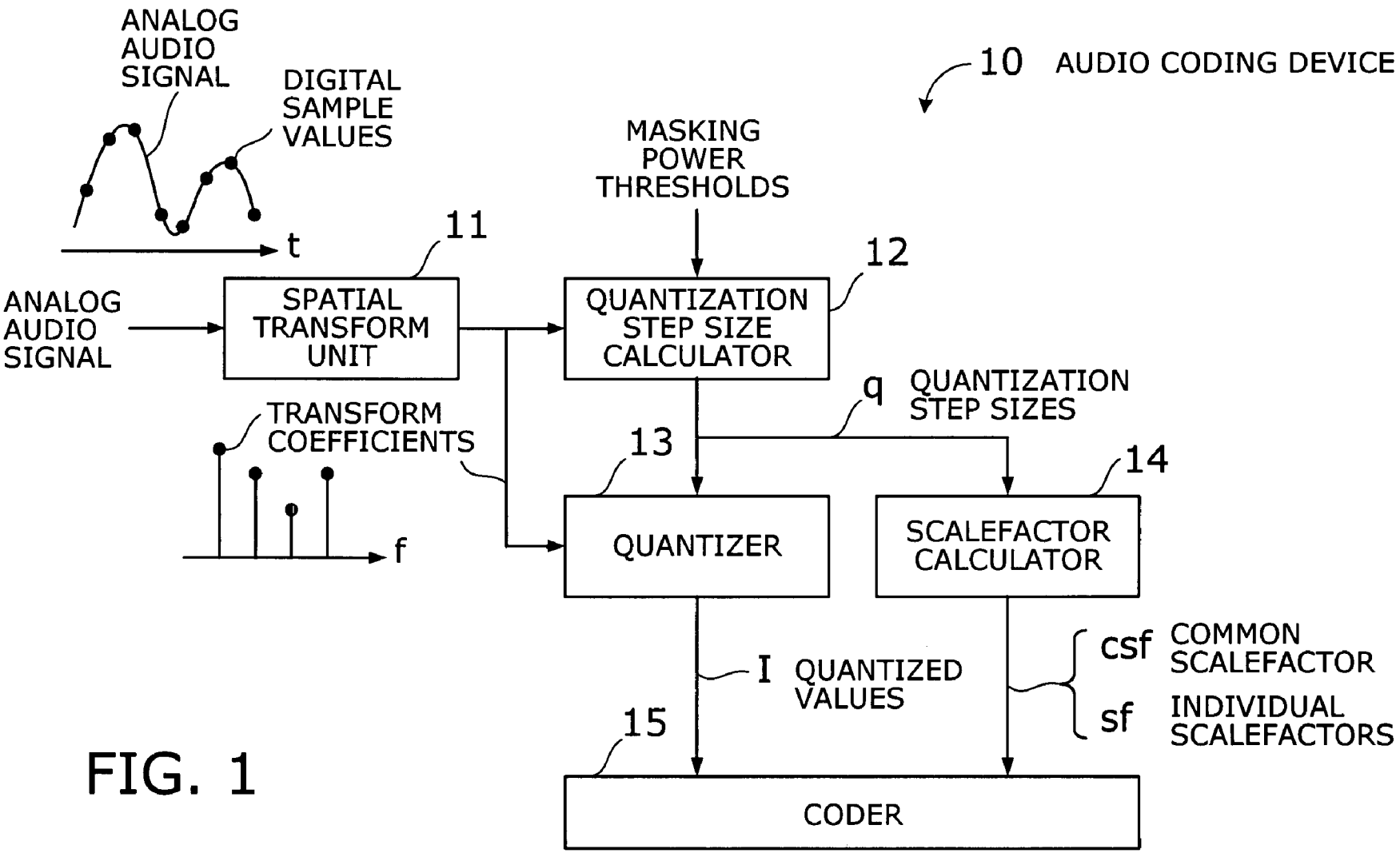
FIG. 1 is a conceptual view of an audio coding device according to an embodiment of the present invention.

Preferred embodiments of the present invention will be described below with reference to the accompanying drawings, wherein like reference numerals refer to like elements throughout.

FIG. 1 is a conceptual view of an audio coding device according to an embodiment of the present invention. The illustrated audio coding device 10 is an encoder for compressing audio signal information, which has, among others, the following elements: a spatial transform unit 11, a quantization step size calculator 12, a quantizer 13, a scalefactor calculator 14, and a coder 15.

The spatial transform unit 11 subjects samples of a given audio signal to a spatial transform process. One example of such a process is the modified discrete cosine transform (MDCT). The resulting transform coefficients are divided into groups called "subbands," depending on their frequency ranges. The quantization step size calculator 12 estimates quantization noise from a representative value selected out of the transform coefficients of each subband. Then the quantization step size calculator 12 calculates, in an approximative way, a quantization step size q for each subband from the estimated quantization noise, as well as from a masking power threshold that is determined from psycho-acoustic characteristics of the human auditory system.

Based on the calculated quantization step sizes q, the quantizer 13 quantizes the transform coefficients, thus producing quantized values I. Also based on those quantization step sizes q, the scalefactor calculator 14 calculates a common scalefactor csf, as well as an individual scalefactor sf specific to each subband. The common scalefactor csf serves as an offset applicable to the entire frame.

Finally the coder 15 encodes at least one of the quantized values I, the common scalefactor csf, and the individual scalefactors sf. The coder 15 uses a coding algorithm such as Huffman encoding, which assigns shorter codes to frequently occurring values and longer codes to less frequently occurring values. The details of quantization noise estimation and quantization step size approximation will be described later with reference to FIG. 10 and subsequent drawings.

Audio Compression

This section describes the basic concept of audio compression of the present embodiment, in comparison with a quantization process of conventional encoders, to clarify the problems that the present invention intends to solve. As an example of a conventional encoder, this section will discuss an MPEG2-AAC encoder. For the specifics of MP3 and MPEG2-AAC quantization methods, see the relevant standard documents published by the International Organization for Standardization (ISO). More specifically, MP3 is described in ISO/IEC 11172-3, and MPEG2-AAC in ISO/IEC 13818-7.

An MPEG2-AAC (or simply AAC) encoder extracts a frame of PCM signals and subjects the samples to spatial transform such as MDCT, thereby converting power of the PCM signal from the time domain to the spatial (frequency) domain. Subsequently the resultant MDCT transform coefficients (or simply "transform coefficients") are directed to a quantization process adapted to the characteristics of the human auditory system. This is followed by Huffman encoding to yield an output bitstream for the purpose of distribution over a transmission line.

The AAC algorithm (as well as MP3 algorithm) quantizes MDCT transform coefficients according to the following formula (1):

$$I=\text{floor}((|X|*2\hat{}(-q/4))\hat{}(3/4)-0.0946) \quad (1)$$

where I is a quantized value, X is an MDCT transform coefficient to be quantized, q is a quantization step size, and "floor" is a C-language function that discards all digits to the right of the decimal point. AˆB means $A^B$, or the B-th power of A. The quantization step size q is given by:

$$q=sf-csf \quad (2)$$

where sf is an individual scalefactor of each subband, and csf is a common scalefactor, or the offset of quantization step sizes in an entire frame.

Here the term "frame" refers to one unit of sampled signals to be encoded. According to the AAC specifications, one frame consists of 1024 transform coefficients obtained from 2048 PCM samples through MDCT.

Figure 2:
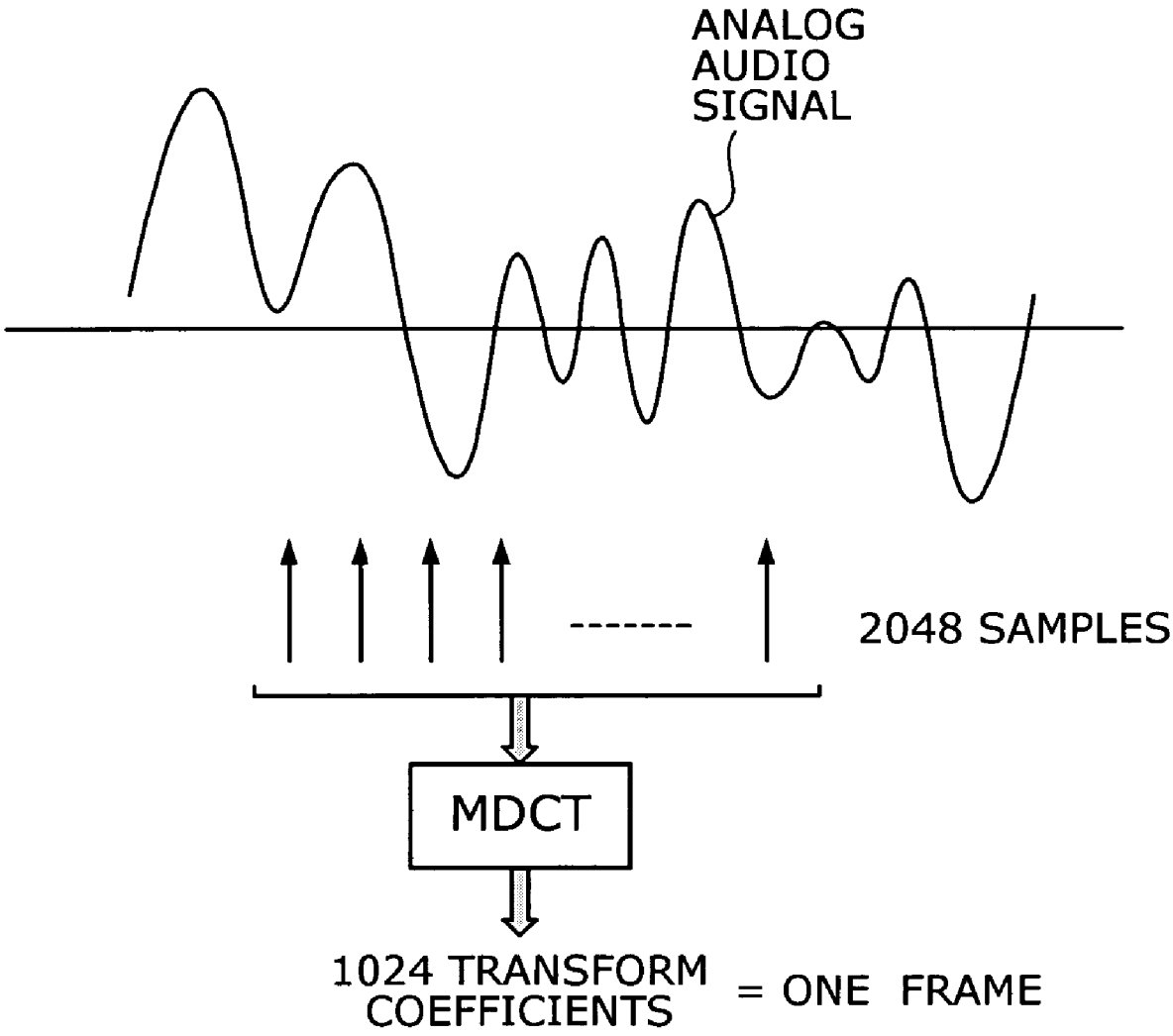
FIG. 2 shows the concept of a frame.

FIG. 2 shows what the frame is. As FIG. 2 illustrates, a segment of a given analog audio signal is first digitized into 2048 PCM samples. The MDCT module then produces 1024 transform coefficients from the samples, which are referred to as a frame. Those transform coefficients are divided into about 50 groups of frequency ranges, or subbands. Each band contains 1 (minimum) to 96 (maximum) transform coefficients. The number of coefficients may be varied according to the characteristics of the human hearing system. Specifically, more coefficients are produced in higher-frequency subbands.

Figure 3:
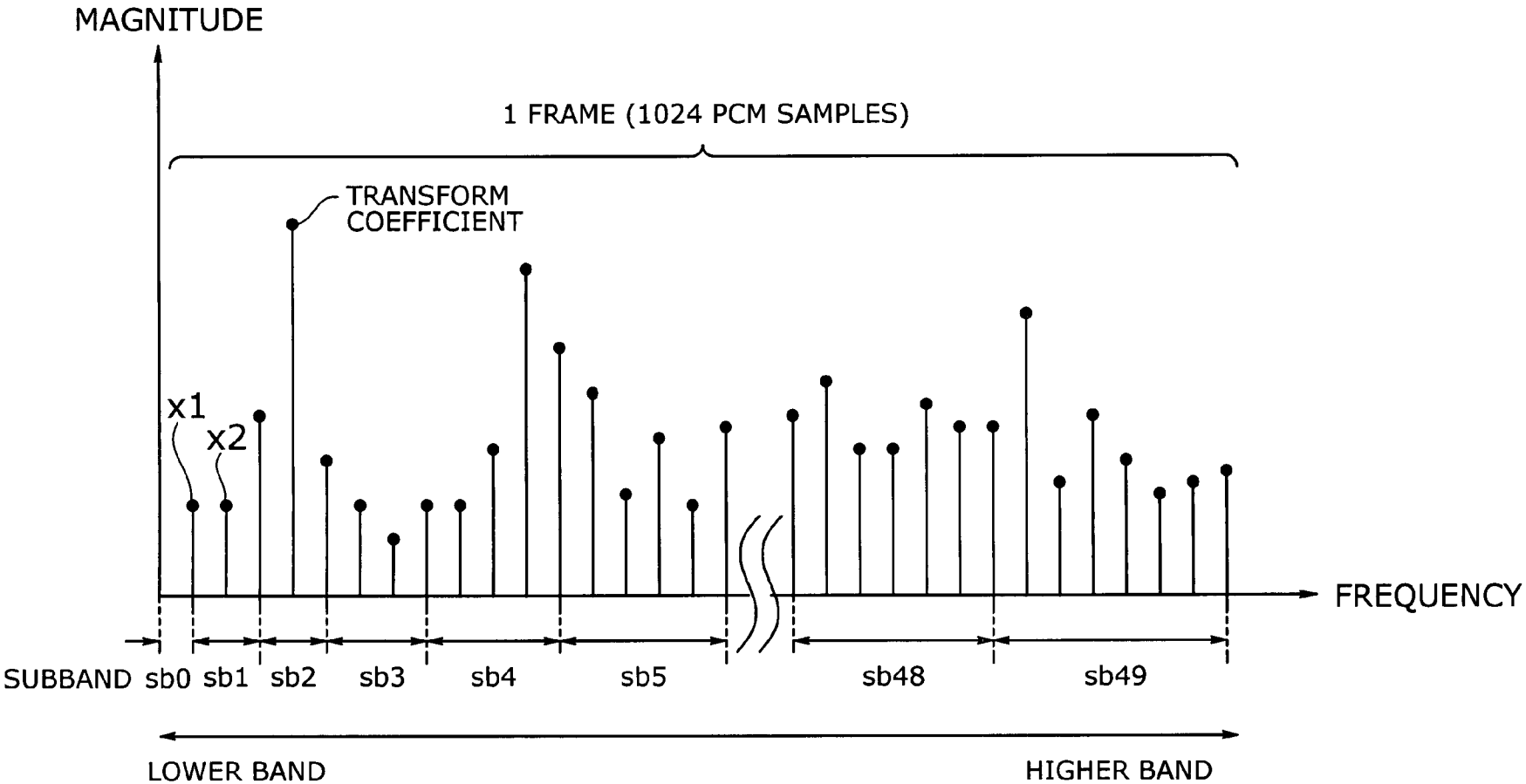
FIG. 3 depicts the concept of transform coefficients and subbands.

FIG. 3 depicts the concept of transform coefficients and subbands, where the vertical axis represents magnitude and the horizontal axis represents frequency. 1024 transform coefficients belong to one of the fifty subbands sb0 to sb49 arranged along the frequency axis. As can be seen from FIG. 3, lower subbands contain fewer transform coefficients (i.e., those subbands are narrower), whereas higher subbands contain more transform coefficients. In other words, higher subbands are wider than lower subbands. This uneven division of subbands is based on the fact that the human perception of sound tends to be sensitive to frequency differences in the bass range (or lower frequency bands), as with the transform coefficients x1 and x2 illustrated in FIG. 3, but not in the treble range (or higher frequency bands). That is, the human auditory system has a finer frequency resolution in low frequency ranges, whereas it cannot distinguish two high-pitch sounds very well. For this reason, the present embodiment of the invention divides a low frequency range into narrow subbands, and a high frequency range into wide subbands, according to the sensitivity to frequency differences.

Figure 4:
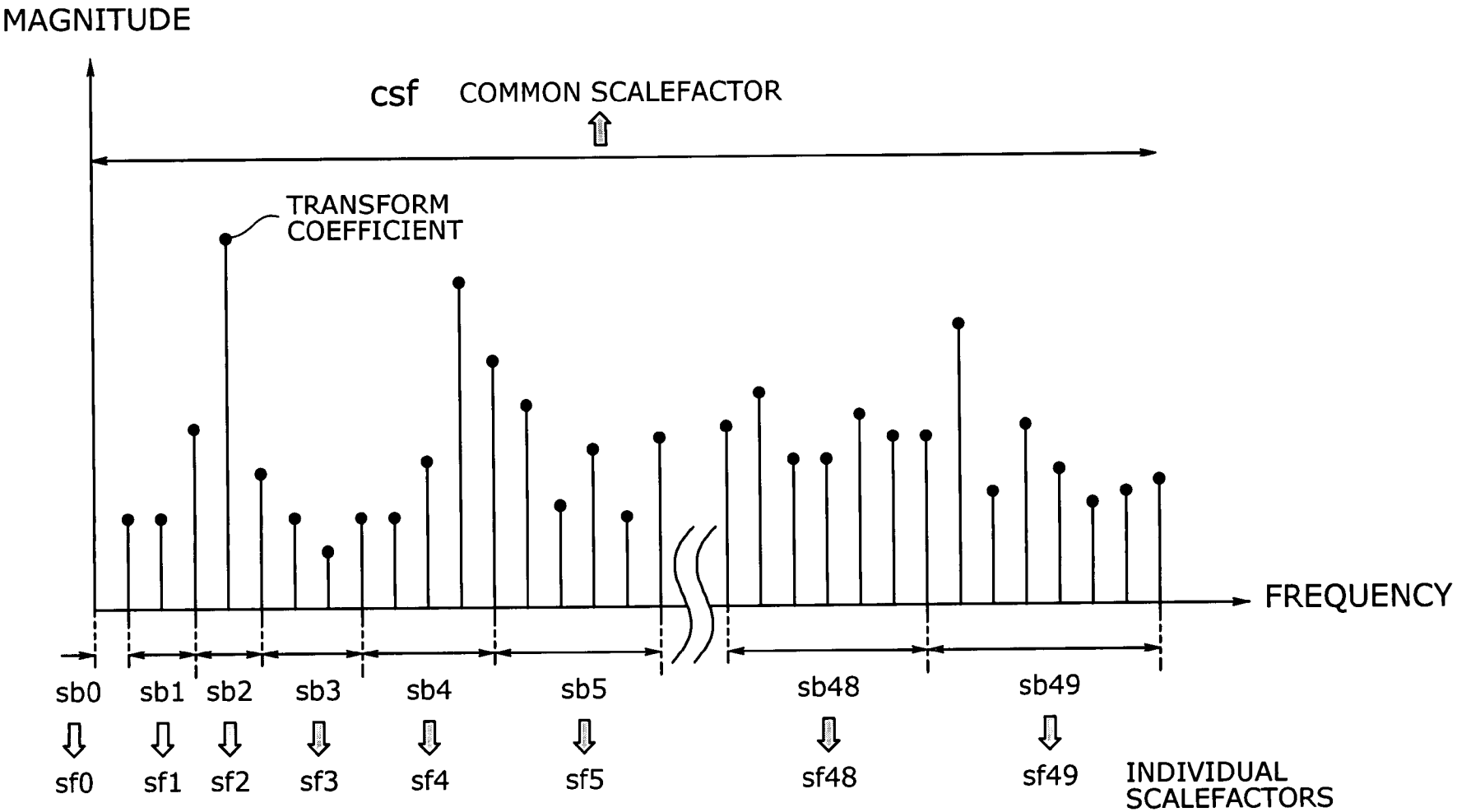
FIG. 4 shows the association between a common scalefactor and scalefactors for a frame.

FIG. 4 shows the association between a common scalefactor and individual scalefactors of a frame. Specifically, FIG. 4 depicts how a common scalefactor csf and individual scalefactors sf0 to sf49 are defined for the subbands discussed in FIG. 3. One single common scalefactor csf is defined for the entire set of subbands sb0 to sb49, and a plurality of subband-specific scalefactors sf0 to sf49 are defined for the individual subbands sb0 to sb49, respectively. In the present example, there are fifty individual scalefactors in total.

Accordingly the aforementioned formula (2) gives the quantization step size q for a subband sb0 as q[sb0]=sf0−csf. Likewise, the quantization step size q for another subband sb1 is given as q[sb1]=sf1−csf. The other quantization step sizes are calculated in the same way.

Figure 5:
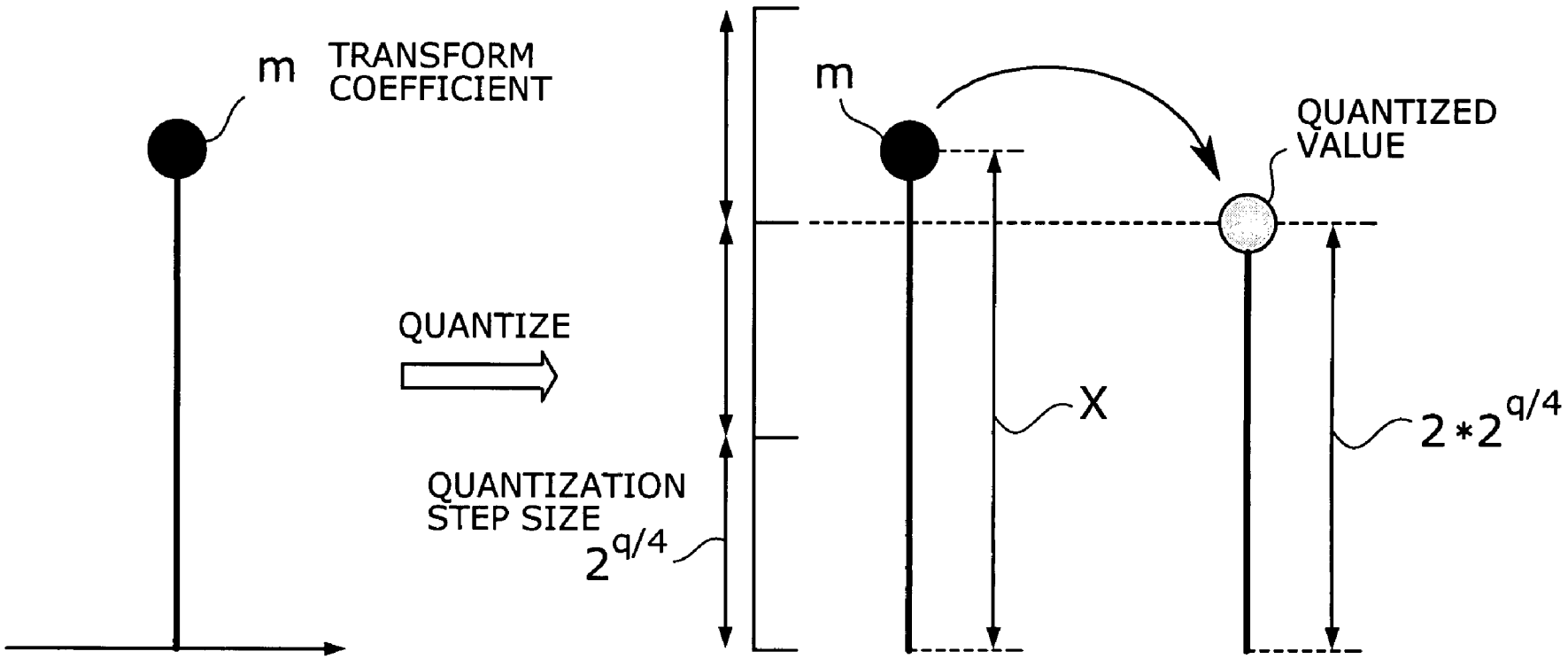
FIG. 5 shows the concept of quantization.

FIG. 5 shows the concept of quantization. Let X be the magnitude of a transform coefficient m. Formula (1) is used to quantize the transform coefficient m, which is approximately equal to an integer obtained by truncating the quotient of X by the quantization step size q (i.e., $I \approx |X|/2^{q/4}$) FIG. 5 depicts this process of dividing the magnitude X by a quantization step size $2^{q/4}$ and discarding the least significant digits right of the decimal point. As a result, the given transform coefficient m is quantized into $2*2^{q/4}$, and the value of 2 is passed to the subsequent coder. Think of a simple example where the division of a given X by a step size of 10 results in a quotient X/10 of 9.6. In this case the fraction of X/10 is discarded, and X is quantized to 9.

As can be seen from FIG. 5, how to select an appropriate quantization step size will be a key issue for improving the quality of encoded audio signals with minimized quantization error. As mentioned earlier, the quantization step size is a function of a given common and individual scalefactors. That is, the most critical point for audio quality in quantization and coding processes is how to select an optimal common scalefactor for a given frame and an optimal set of individual scalefactors for its subbands. Once both kinds of scalefactors are optimized, the quantization step size of each subband can be calculated from formula (2). Then the transform coefficients in each subband sb are quantized by substituting the result into formula (1), (i.e., by dividing them by the corresponding step size). Each quantized value is encoded into a Huffman code for transmission purposes, by consulting a Huffman table indexed with quantized values. The problem here, however, is that the method specified in the related ISO standards requires a considerable amount of computation to yield optimal common and individual scalefactors. The reason will be described in the next paragraphs.

Figure 6:
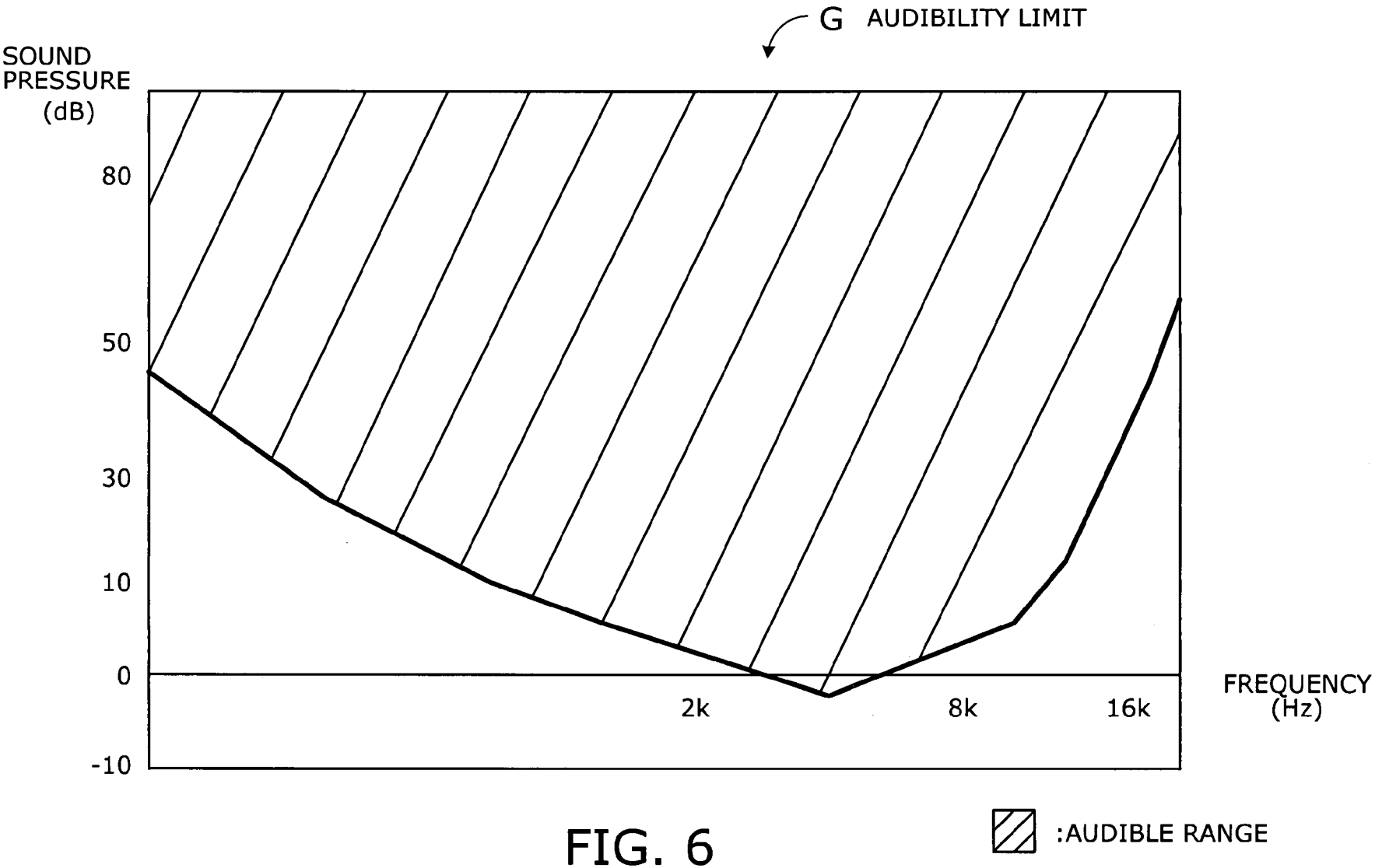
FIG. 6 is a graph showing audibility limit.

Common and individual scalefactors are determined in accordance with masking power thresholds, a set of parameters representing one of the characteristics of the human auditory system. The masking power threshold refers to a minimum sound pressure that humans can perceive. FIG. 6 is a graph G showing a typical audibility limit, where the vertical axis represents sound pressure (dB) and the horizontal axis represents frequency (Hz). The sensitivity of ears is not constant in the audible range (20 Hz to 20,000 Hz) of humans, but heavily depends on frequencies. More specifically, the peak sensitivity is found at frequencies of 3 kHz to 4 kHz, with sharp drops in both low-frequency and high-frequency regions. This simply means that low- or high-frequency sound components would not be heard unless the volume is increased to a sufficient level.

Referring to the graph G of FIG. 6, the hatched part indicates the audible range. The human ear needs a larger sound pressure (volume) in both high and low frequencies, whereas the sound in the range between 3 kHz and 4 kHz can be heard even if its pressure is small. Particularly, the hearing ability of elderly people is limited to a narrow range of frequencies. Based on this graph G of audibility limits, a series of masking power thresholds are determined with the fast Fourier transform (FFT) technique. The masking power threshold at a frequency f gives a minimum sound level L that human can perceive.

Figure 7:
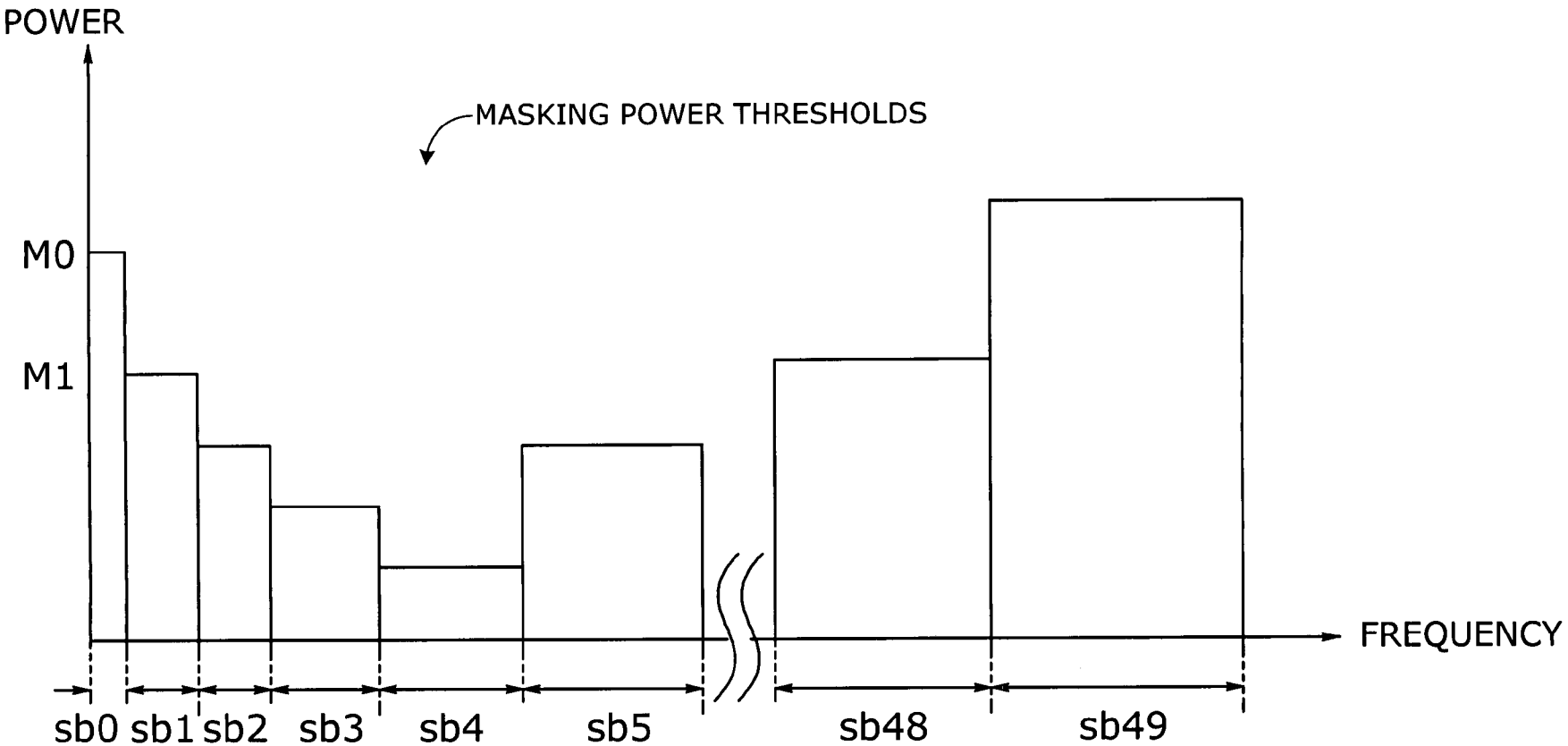
FIG. 7 shows an example of masking power thresholds.

FIG. 7 shows an example of masking power thresholds, the vertical axis represents threshold power, and the horizontal axis represents frequency. The range of frequency components of a frame is divided into fifty subbands sb0 to sb49, each having a corresponding masking power threshold.

Specifically, a masking power threshold M0 is set to the lowest subband sb0, meaning that it is hard to hear a signal (sound) in that subband sb0 if its power level is M0 or smaller. The audio signal processor can therefore regard the signals below this threshold M0 as noise, in which sense the masking power threshold may also be referred to as the permissible noise thresholds. Accordingly, the quantizer has to be designed to process every subband in such a way that the quantization error power of each subband will not exceed the corresponding masking power threshold. This means that the individual and common scalefactors are to be determined such that the quantization error power in each subband (e.g., sb0) will be smaller than the masking power threshold (e.g., M0) of that subband.

Located next to sb0 and M0 are the second lowest subband sb1 and its associated masking power threshold M1, where M1 is smaller than M0. As can be seen, the magnitude of maximum permissible noise is different from subband to subband. In the present example, the first subband sb0 is more noise-tolerant than the second subband sb1, meaning that sb0 allows larger quantization errors than sb1 does. It is therefore allowed to use a coarser step size when quantizing the first subband sb0. Since the second subband sb1 in turn is more noise-sensitive, a finer step size should be assigned to sb1 so as to reduce the resulting quantization error.

Of all subbands in the frame shown in FIG. 7, the fifth subband sb4 has the smallest masking power threshold, and the highest subband sb49 has the largest. Accordingly, the former subband sb4 should be assigned a smallest quantization step size to minimize the quantization error and its consequent audible distortion. The latter subband sb49, on the other hand, is the most noise-tolerant subband, thus accepting the coarsest quantization in the frame.

The above-described masking power thresholds have to be taken into consideration in the process of determining each subband-specific scalefactor and a common scalefactor for a given frame. Other related issues include the restriction of output bitrates. Since the bitrate of a coded bit stream (e.g., 128 kbps) is specified beforehand, the number of coded bits produced from every given sound frame must be within that limit.

The AAC specifications provide a temporary storage mechanism, called "bit reservoir," to allow a less complex frame to give its unused bandwidth to a more complex frame that needs a higher bitrate than the defined one. The number of coded bits is calculated from a specified bitrate, perceptual entropy in the acoustic model, and the amount of bits in the bit reservoir. The perceptual entropy is derived from a frequency spectrum obtained through FFT of a source audio signal frame. In short, the perceptual entropy represents the total number of bits required to quantize a given frame without producing as large noise as listeners can notice. More specifically, broadband signals such as an impulse or white noise tend to have a large perceptual entropy, and more bits are therefore required to encode them correctly.

Conventional Algorithm

As can be seen from the above discussion, the encoder has to determine two kinds of scalefactors, satisfying the limit of masking power thresholds, as well as the restriction of bandwidth available for coded bits. The conventional ISO-standard technique implements this calculation by repeating quantization and dequantization while changing the values of scalefactors one by one. This conventional calculation process begins with setting initial values of individual and common scalefactors. With those initial scalefactors, the process attempts to quantize given transform coefficients. The quantized coefficients are then dequantized in order to calculate their respective quantization errors (i.e., the difference between each original transform coefficient and its dequantized version). Subsequently the process compares the maximum quantization error in a subband with the corresponding masking power threshold. If the former is greater than the latter, the process increases the current scalefactor and repeats the same steps of quantization, dequantization, and noise power evaluation with that new scalefactor. If the maximum quantization error is smaller than the threshold, then the process advances to the next subband.

Finally the quantization error in every subband falls below its corresponding masking power threshold, meaning that all scalefactors have been calculated. The process now passes the quantized values to a Huffman encoding algorithm to reduce the data size. It is then determined whether the amount of the resultant coded bits does not exceed the amount allowed by the specified coding rate. The process will be finished if the resultant amount is smaller than the allowed amount. If the resultant amount exceeds the allowed amount, then the process must return to the first step of the above-described loop after incrementing the common scalefactor by one. With this new common scalefactor and the re-initialized individual scalefactors, the process executes another cycle of quantization, dequantization, and evaluation of quantization errors and masking power thresholds.

Figure 8:
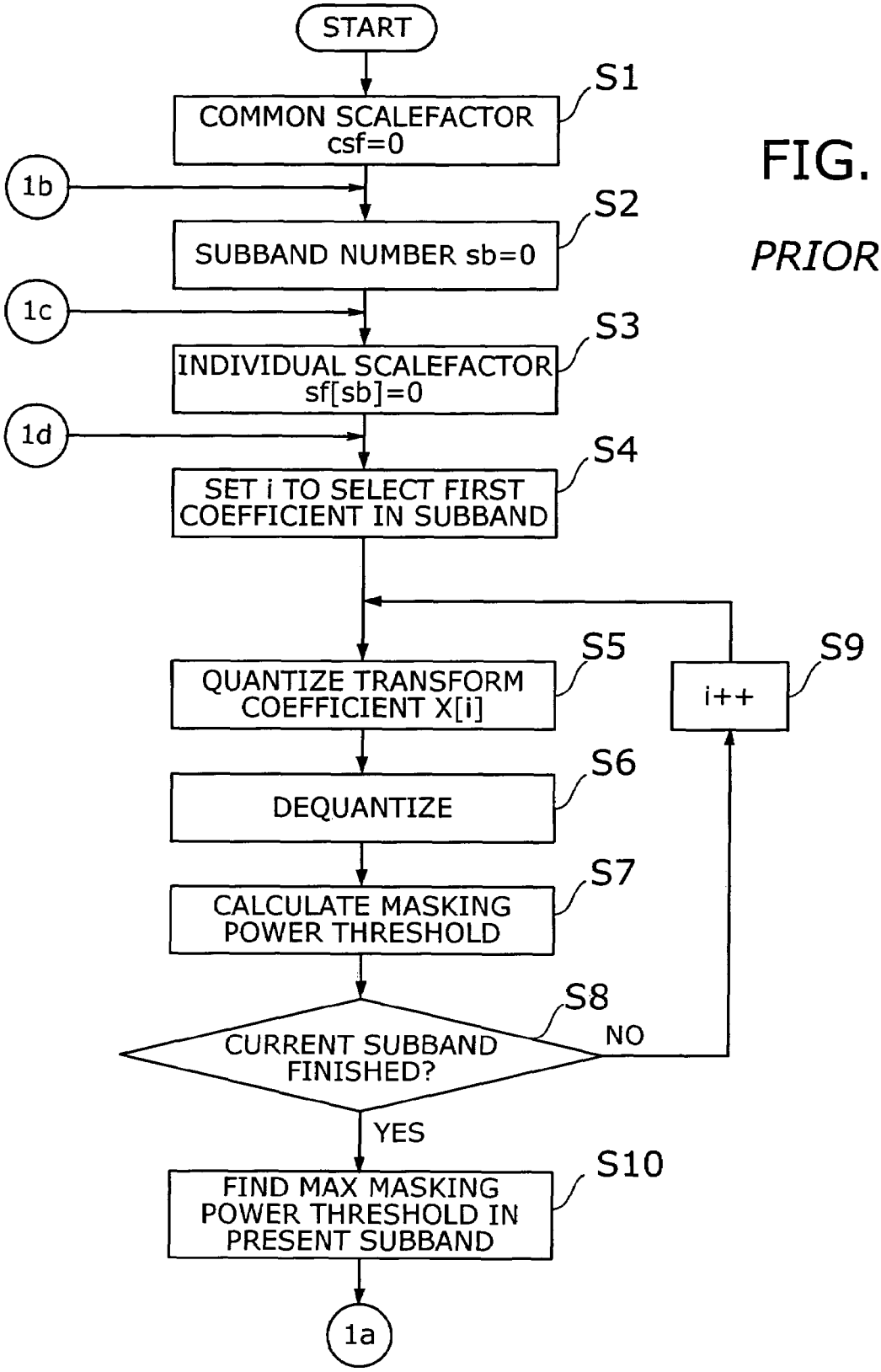
FIG. 8 PRIOR ART
FIGS. 8 and 9 show a flowchart of conventional quantization and coding processes.
Figure 9:
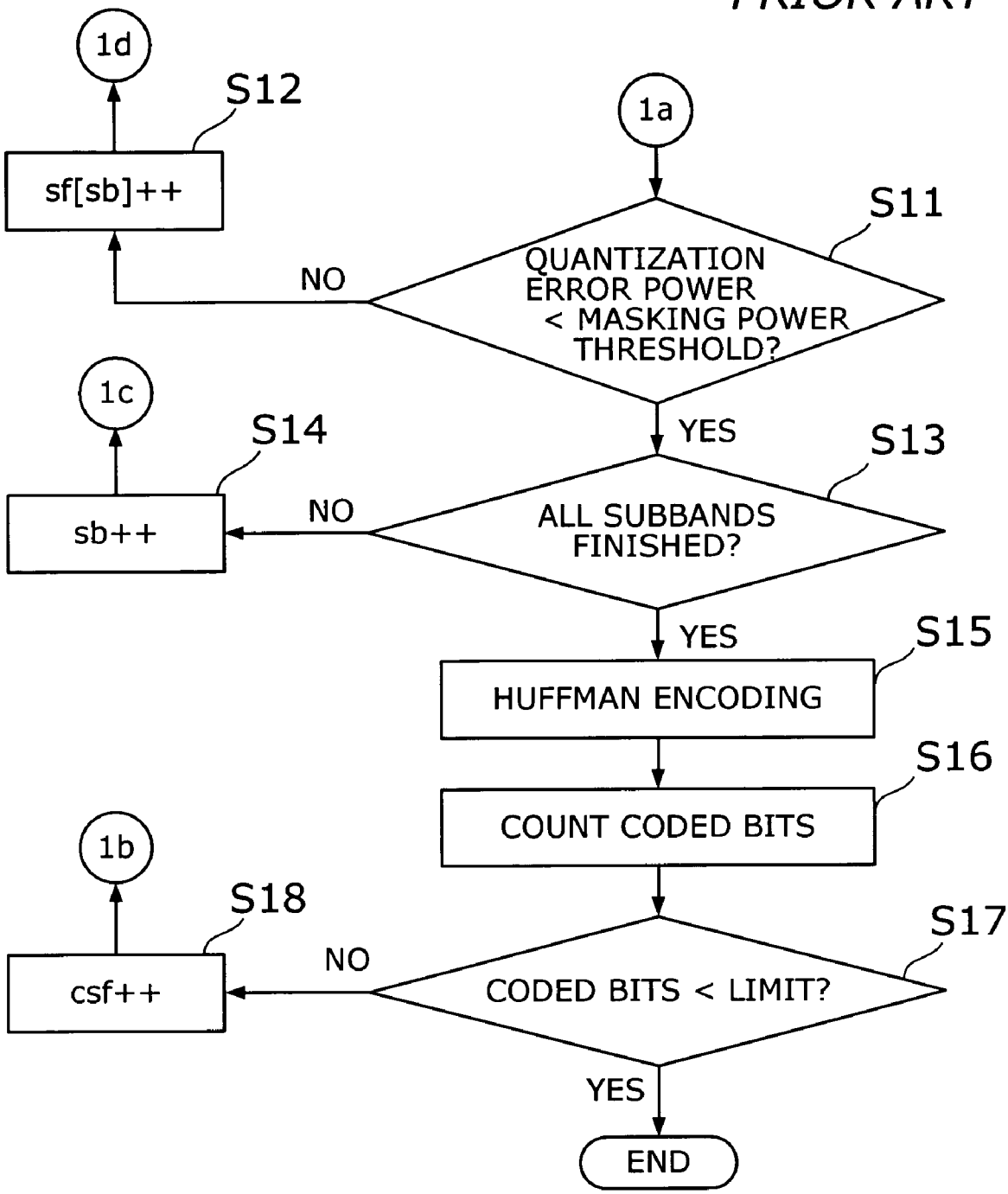
FIG. 9 PRIOR ART

FIGS. 8 and 9 show a flowchart of a conventional quantization and coding process. The encoder takes a traditional iterative approach to calculate scalefactors as follows:

(S1) The encoder initializes the common scalefactor csf. The AAC specification defines an initial common scalefactor as follows:

$$csf=(16/3)*(\log_2(Xmax\hat{}(3/4)/8191)) \quad (3)$$

where Xmax represents the maximum transform coefficient in the present frame.

(S2) The encoder initializes a variable named sb to zero. This variable sb indicates which subband to select for the following processing.

(S3) The encoder initializes the scalefactor sf[sb] of the present subband to zero.

(S4) The encoder initializes a variable named i. This variable i is a coefficient pointer indicating which MDCT transform coefficient to quantize.

(S5) The encoder quantizes the ith transform coefficient X[i] according to the following formulas (4a) and (4b).

$$q=csf-sf[sb] \quad (4a)$$

$$QX[i]=\text{floor}((|X[i]|*2\hat{}(-q/4))\hat{}3/4-0.0946) \quad (4b)$$

where QX[i] is a quantized version of the given coefficient X[i]. Formulas (4a) and (4b) are similar to formulas (2) and (1), respectively. Note that formulas (4a) and (4b) have introduced variables sb and i as element pointers.

(S6) The encoder dequantizes the quantized transform coefficient according to the following formula (5).

$$X^{-1}[i]=QX[i]\hat{}(4/3)*2\hat{}(-1/4*q) \quad (5)$$

where $X^{-1}[i]$ represents the dequantized value.

(S7) The encoder calculates a quantization error power (noise power) N[i] resulting from the preceding quantization and dequantization of X[i].

$$N[i]=(X^{-1}[i]-QX[i])\hat{}2 \quad (6)$$

(S8) The encoder determines whether all transform coefficients in the present subband are finished. If so, the encoder advances to step S10. If not, the encoder goes to step S9.

(S9) The encoder returns to step S5 with a new value of i.

(S10) The encoder finds a maximum quantization error power MaxN within the present subband.

(S11) The encoder compares the maximum quantization error power MaxN with a masking power threshold M[sb] derived from a psycho-acoustic model. If MaxN<M[sb], then the encoder assumes validity of quantized values for the time being, thus advancing to step S13. Otherwise, the encoder branches to step S12 to reduce the quantization step size.

(S12) The encoder returns to step S4 with a new scalefactor sf[sb].

(S13) The encoder determines whether all subbands are finished. If so, the encoder advances to step S15. If not, the encoder proceeds to step S14.

(S14) The encoder returns to step S3 after incrementing the subband number sb.

(S15) Now that all transform coefficients have been quantized, the encoder performs Huffman encoding.

(S16) From the resulting Huffman-coded values, the encoder calculates the number of coded bits that will consume bandwidth.

(S17) The encoder determines whether the number of coded bits is below a predetermined number. If so, the encoder can exit from the present process of quantization and coding. Otherwise, the encoder proceeds to step S18.

(S18) The encoder returns to step S2 with a new value of csf.

As can be seen from the above process flow, the conventional encoder makes exhaustive calculation to seek an optimal set of quantization step sizes (or common and individual scalefactors). That is, the encoder repeats the same process of quantization, dequantization, and encoding for each transform coefficient until a specified requirement is satisfied. Besides requiring an extremely large amount of computation, this conventional algorithm may fail to converge and fall into an endless loop. If this is the case, a special process will be invoked to relax the requirement. To solve the problem of such poor computational efficiency of conventional encoders, the present invention provides an audio coding device that achieves the same purpose with less computational burden.

Single-Pass Algorithm for Step Size Calculation

This section describes in detail the process of estimating quantization noise and approximating quantization step sizes. This process is performed by the quantization step size calculator 12 (FIG. 1) according to the present embodiment. To realize a lightweight encoding device, the present embodiment calculates both common and individual scalefactors by using a single-pass approximation technique.

The audio coding device of the present embodiment calculates a quantized value I using a modified version of the foregoing formula (1). More specifically, when a quantization step size is given, the following formula (7) quantizes Xa as:

$$\begin{aligned} I &= (|Xa|*2\hat{}(-q/4))\hat{}(3/4)-0.0946 \quad (7)\\ &= |Xa|\hat{}(3/4)*2\hat{}((-q/4)*(3/4))-0.0946\\ &= |Xa|\hat{}(3/4)*2\hat{}(-3q/16)-0.0946 \end{aligned}$$

where the truncation function "floor" is hidden on the right side for simplicity purposes. Xa is a representative value selected from among the transform coefficients of each subband. More specifically, this representative value Xa may be the mean value of a plurality of transform coefficients in the specified subband, or alternatively, it may be a maximum value of the same.

By replacing |Xa|^(3/4) with a symbol A, the above formula (7) can be rewritten as follows:

$$I=A*2\hat{}(-3q/16)-0.0946 \quad (8)$$

Notice that A is divided by $2^{(3q/16)}$ in this formula (8), which means that A is quantized with a step size of $2^{(3q/16)}$. The denominator, $2^{(3q/16)}$, is a critical parameter that affects the quantization accuracy. Since the average error of quantization is one-half the step size used, the following expression gives a mean quantization noise:

$$2\hat{}(3q/16)/2=2\hat{}((3q/16)-1) \quad (9)$$

Figure 10:
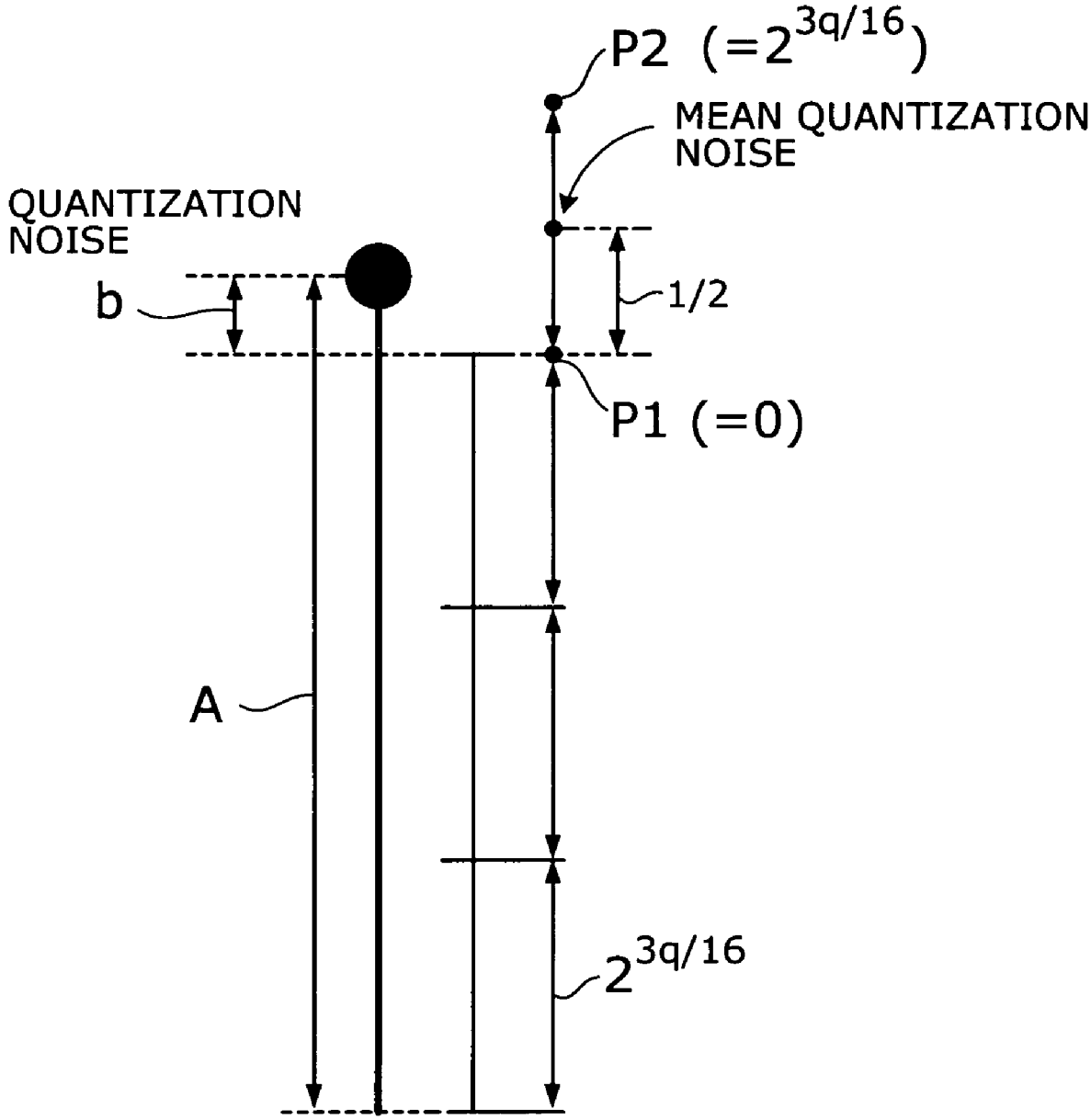
FIG. 10 depicts mean quantization noise.

FIG. 10 depicts this mean quantization noise. Specifically, FIG. 10 illustrates a magnitude of A with respect to a quantization step size of $2^{(3q/16)}$. The symbol b represents the difference between the true magnitude of A and its corresponding quantized value P1. In other words, the difference b is a quantization noise (or quantization error) introduced as a result of quantization with a step size of $2^{(3q/16)}$. When A is exactly at the position of P1 (i.e., when A is a multiple of $2^{(3q/16)}$), the difference b is zero, which is the minimum of quantization noise. When, on the other hand, A is immediately below P2, the difference b nearly equals $2^{(3q/16)}$, which is the largest value that a quantization noise can have. Assuming that the quantization noise distributes uniformly in the range of 0 to $2^{(3q/16)}$, the mean quantization noise of A will be one half of $2^{(3q/16)}$ (i.e., average of distribution), and hence the above expression (9).

While the average quantization noise of A is known, what is really needed is that of Xa. If it can be assumed that A had a linear relationship with Xa (i.e., A=k*|Xa|), then it would be allowed to use the mean quantization noise expression of expression (9) as the mean quantization noise of Xa. In actuality, however, their relationship is nonlinear. A=|Xa|^(¾) means that A is proportional to the (¾)th power of Xa, or that the signal Xa is compressed in a nonlinear fashion. For this reason, expression (9) cannot be used directly as the mean quantization noise of Xa.

Figure 11:
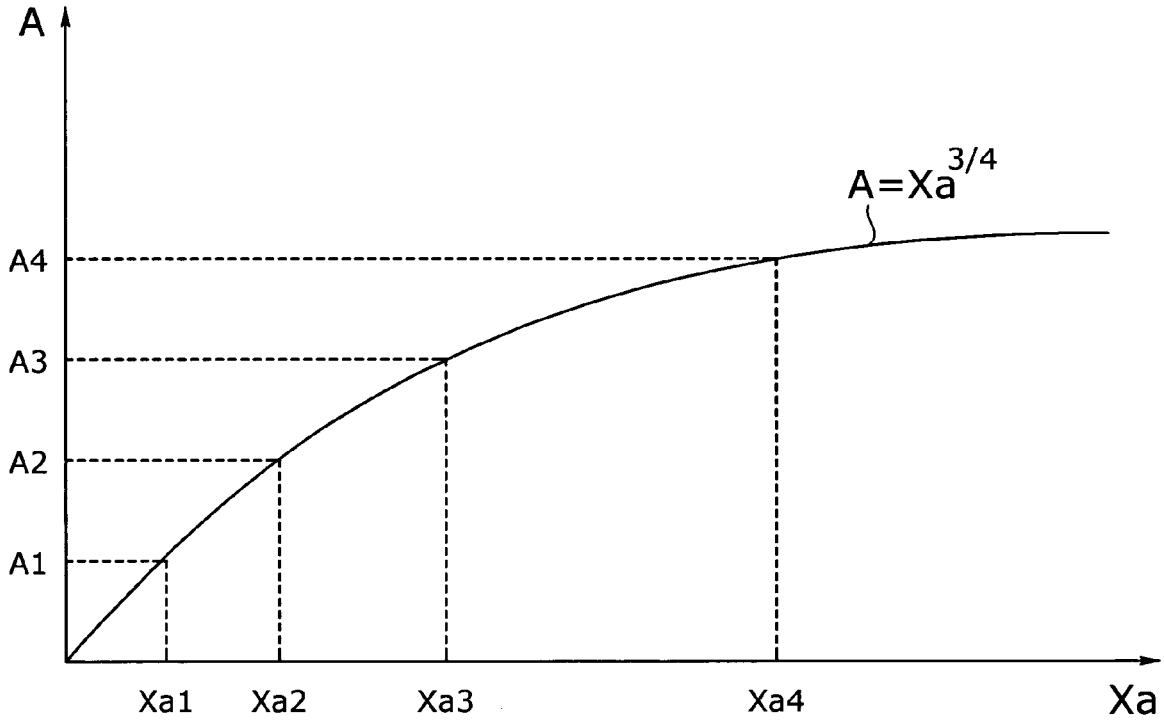
FIG. 11 shows the relationship between A and Xa.

FIG. 11 shows the relationship between A and Xa. This graph plots an exponential curve of A=Xa^(¾), with A on the vertical axis and Xa on the horizontal axis. The A-axis is divided into equal sections, A1, A2, and so on, and the Xa-axis is also divided accordingly into Xa1, Xa2, and so on. Note that the intervals of Xa1, Xa2, and so on are not even, but expands as Xa grows.

As seen from the above, Xa is quantized in a nonlinear fashion, where the quantization step size varies with the amplitude of Xa. It is therefore necessary to make an appropriate compensation for the nonlinearity of quantization step size $2^{(3q/16)}$ when calculating a quantization noise of Xa. Let r be a correction coefficient (nonlinear compression coefficient) defined as follows:

$$r=|Xa|/(|Xa|\hat{}(3/4))=|Xa|\hat{}(1/4) \quad (10)$$

Figure 12:
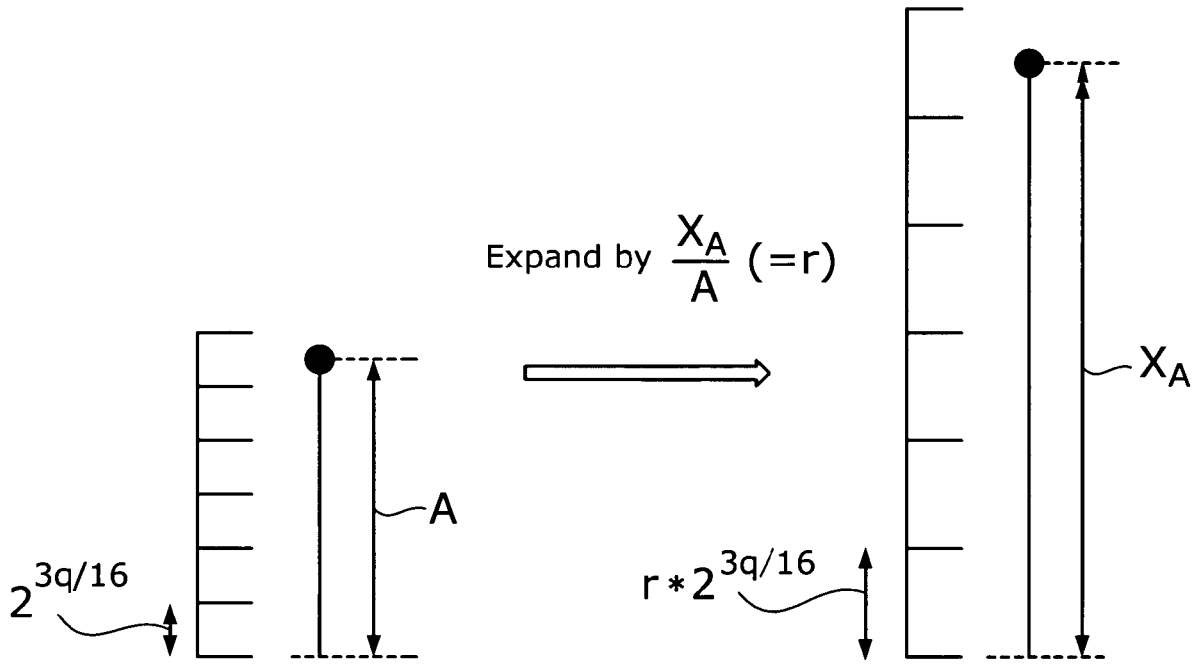
FIG. 12 explains how to calculate a correction coefficient.

FIG. 12 explains how to calculate this correction coefficient r. Assuming now that A is to be quantized with a step size of $2^{(3q/16)}$, let us think of expanding A up to the magnitude of $X_A$. That is, A will be multiplied by a ratio of $r=X_A/A$ since A equals |Xa|^(¾). This is what the above formula (10) means.

The quantization step size is also expanded by the same ratio r. Suppose, for example, that A is 7 and the quantization step size is 2. Xa=10.5 and r=10.5/7=1.5 in this case. The expanded quantization step size will be 2*1.5=3. Accordingly, the mean quantization noise of |Xa| is obtained by multiplying the mean quantization noise (or estimated quantization noise) of A by the correction coefficient r, where the multiplicand and multiplier are given by the foregoing formulas (9) and (10), respectively. This calculation is expressed as:

$$2\hat{}((3q/16)-1)*|Xa|\hat{}(1/4) \quad (11)$$

In the context of quantization of |Xa|^(¾) with a step size of $2^{(3q/16)}$ (actually, a division of {|Xa|^(¾)} by $2^{(3q/16)}$), the first half of expression (11) is interpreted as dividing that divisor by a value of 2. The second half of expression (11) compensates the result of the first half by a correction coefficient r.

Using the mean quantization noise of Xa, the quantization step size calculator 12 then selects an appropriate quantization step size q, not to exceed the masking power threshold M of the corresponding subband in which the calculated mean quantization noise of Xa is applicable. Specifically, q is calculated by equating the expression (11) with the square root of the masking power threshold M (i.e., the amplitude of M) as follows:

$$M\hat{}(1/2)=2\hat{}((3q/16)-1)*|Xa|\hat{}(1/4) \quad (12)$$

This equation (12) is then expanded as follows:

$$2\hat{}((3q/16)-1)=M\hat{}(1/2)*|Xa|\hat{}(-1/4) \quad (13a)$$

$$(3q/16)-1=\log_2(M\hat{}(1/2)*|Xa|\hat{}(-1/4)) \quad (13b)$$

$$q=[\log_2\{M\hat{}(1/2)*|Xa|\hat{}(-1/4)\}+1]*16/3 \quad (13c)$$

The result is formula (13c) for a quantization step size q of a specified subband.

While the above algorithm uses mean quantization noise to approximate a quantization step size, it is also possible to calculate the same from maximum quantization noise. In the present example, the maximum quantization noise of A is 2^(3q/16). Then the maximum quantization noise of |Xa| is obtained by multiplying it by a correction coefficient r as follows:

$$2\hat{}(3q/16)*|Xa|\hat{}(1/4) \quad (14)$$

The quantization step size q in this case is calculated in the same way as above. That is, b is determined by equating the expression (14) with an amplitude version of the masking power threshold M as follows:

$$q=[\log_2\{M\hat{}(1/2)*|Xa|\hat{}(-1/4)\}]*16/3 \quad (15)$$

The mean quantization noise mentioned above is $2^{(3q/16)}$ divided by $2^1$, and the maximum quantization noise is $2^{(3q/16)}$ divided by $2^0$. Quantization noise values can thus be expressed as $2^{(3q/16)}/2^n$ in general form, where n is 0, 1, 2, and so on. With this general expression, the quantization step size is now written as:

$$q=[\log_2\{M\hat{}(1/2)*|Xa|\hat{}(-1/4)\}+n]*16/3 \quad (16)$$

where n is 0, 1, 2, and so on. The value of q at n=0 represents the case where maximum quantization noise and masking power threshold are used. The value of q at n=1 represents the case where mean quantization noise and masking power are used.

Now that the quantization step size calculator 12 has determined an appropriate quantization step size q by using the approximation technique described above, the quantizer 13 uses this q in a subsequent calculation of formula (1), thereby quantizing each transform coefficient X. The resulting quantized values are subjected to Huffman encoding at the coder 15 for the purpose of transmission.

The audio coding device 10 is supposed to send individual and common scalefactors, together with the quantized values, to the destination decoder (not shown). It is therefore necessary to calculate individual and common scalefactors from quantization step sizes q. As discussed earlier, conventional coding devices use formula (3) to calculate a common scalefactor. According to the present invention, the scalefactor calculator 14 simply chooses a maximum quantization step size from among those approximated in all individual subbands in a frame and outputs it as a common scalefactor. The scalefactor calculator 14 also calculates an individual scalefactor of each subband according to the following formula (17), which is derived from formula (2).

$$sf[sb]=csf-q[sb]=\max.q-q[sb] \quad (17)$$

where max.q represents the maximum quantization step size. In this way the scalefactor calculator 14 produces individual and common scalefactors on the basis of quantization step sizes q. The coder 15 sends out those individual and common scalefactors after compressing them with Huffman encoding techniques. Note additionally that the present embodiment uses a maximum quantization step size as a common scalefactor because, by doing so, the coder 15 can work more effectively in coding scalefactors with a reduced number of bits.

Figure 13:
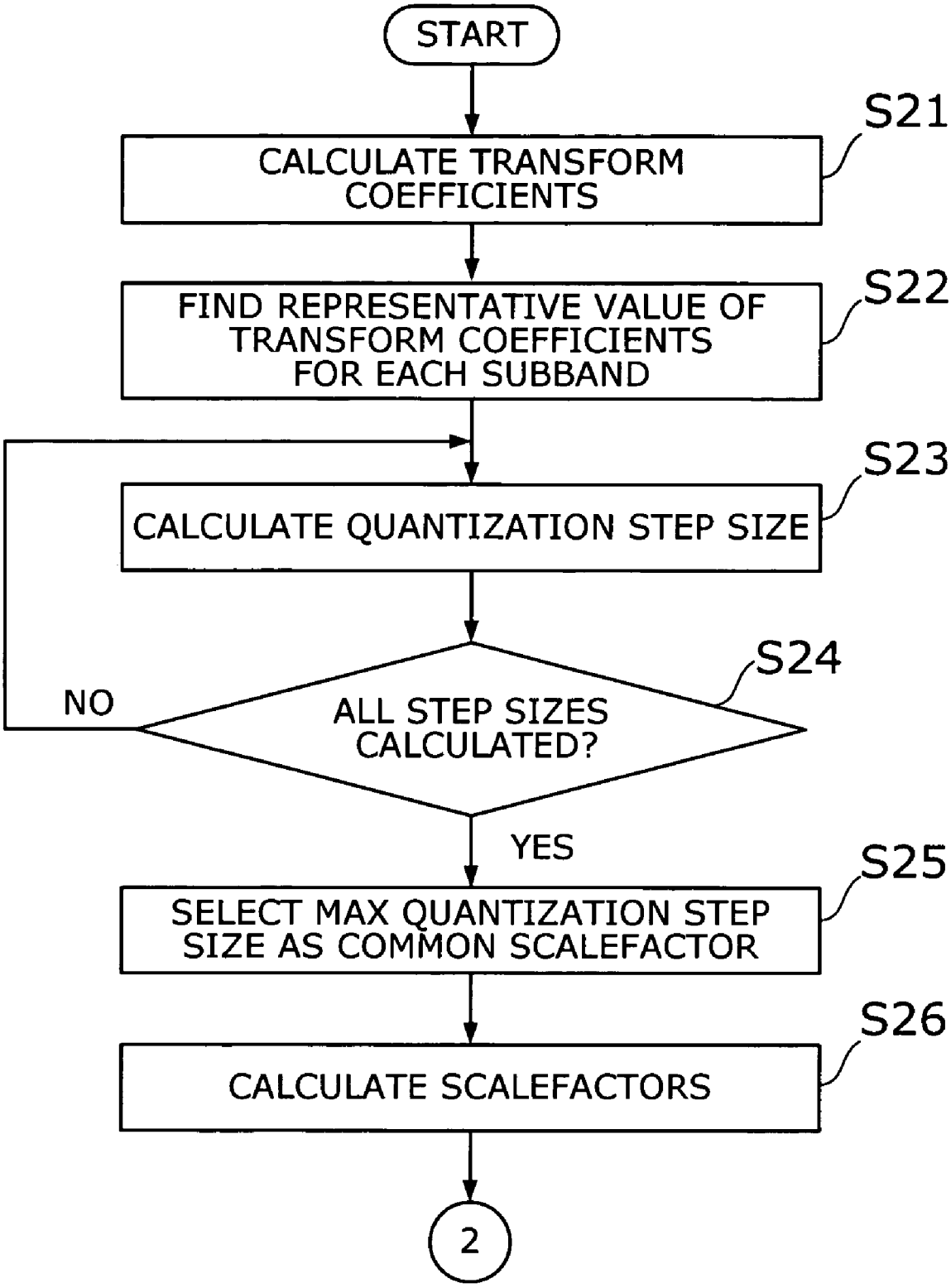
FIGS. 13 and 14 show a flowchart of the entire processing operation according to the present invention.
Figure 14:
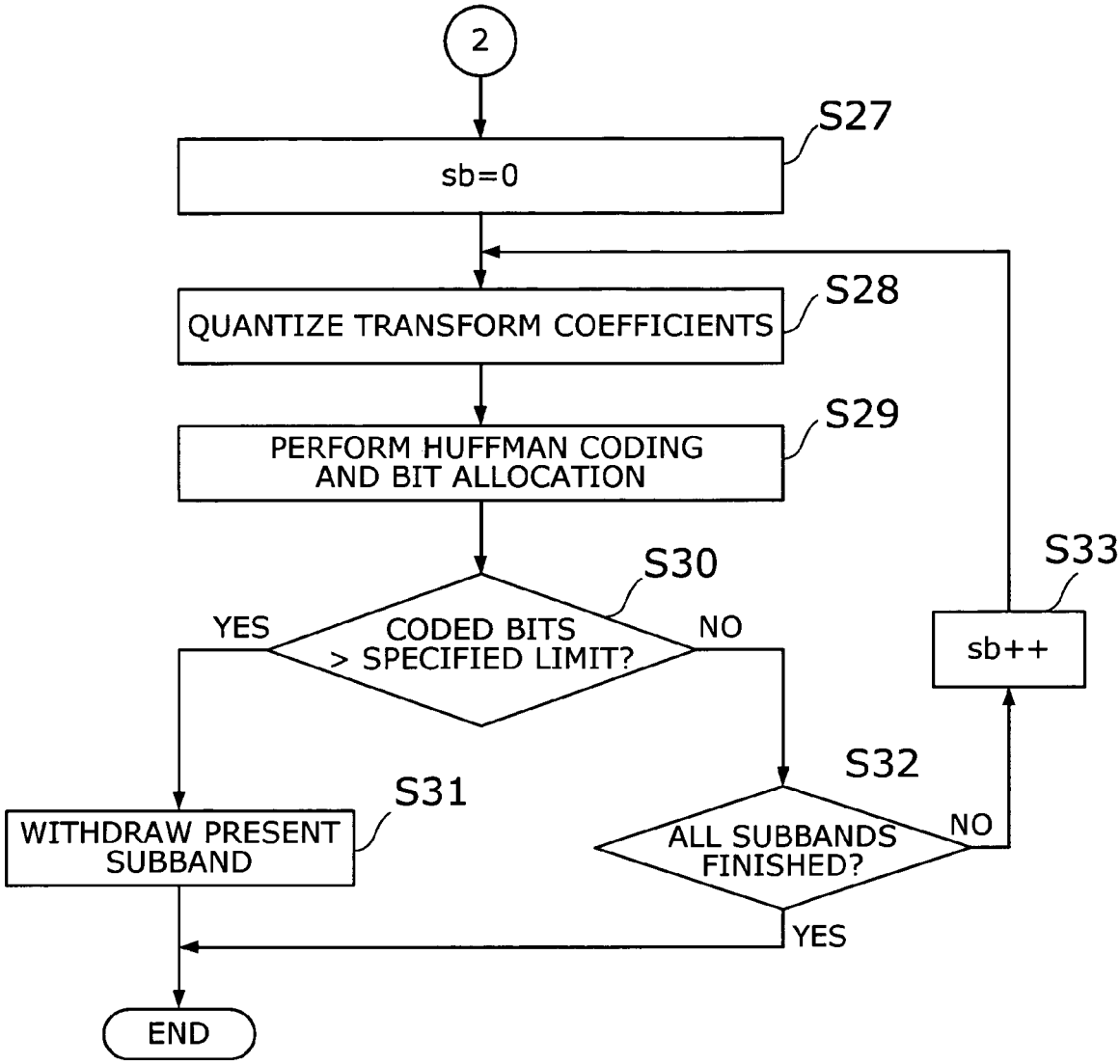

The following will describe the entire operation of the present embodiment with reference to the flowchart of FIGS. 13 and 14. The illustrated process includes the following steps:

(S21) The spatial transform unit 11 calculates transform coefficients by subjecting given PCM samples to MDCT.

(S22) For each subband, the quantization step size calculator 12 chooses a representative value of the transform coefficients. This step may be implemented in the spatial transform unit 11.

(S23) With formula (13c), the quantization step size calculator 12 calculates a quantization step size q of the present subband.

(S24) The quantization step size calculator 12 determines whether it has calculated quantization step size for all subbands in a frame. If so, the process advances to step S25. If not, the process returns to step S23.

(S25) The scalefactor calculator 14 selects a maximum quantization step size for use as a common scalefactor.

(S26) Using formula (17), the scalefactor calculator 14 calculates subband-specific individual scalefactors.

(S27) A variable named sb is initialized to zero (sb=0). This variable sb indicates which subband to select for the subsequent quantization processing.

(S28) Using formula (1), together with the quantization step size of each subband, the quantizer 13 quantizes transform coefficients in the present subband.

(S29) The coder 15 applies Huffman encoding to the quantized values, common scalefactor, and individual scalefactor. The coder 15 now can see the number on coded bits that it has produced so far.

(S30) The coder 15 determines whether the number of coded bits exceeds a specified limit. Here the coded bits include Huffman-encoded quantized values, common scalefactors, and individual scalefactors. If the number of coded bits exceeds the limit, the process advances to step S31. If not, the process proceeds to step S32.

(S31) Because adding the coded bits of the present subband would cause an overflow, the coder 15 withdraws the present subband and exits from the coding process.

(S32) The coder 15 determines whether all subbands are finished. If so, the process is terminated. If not, the process goes to step S33.

(S33) The coder 15 returns to step S28 after incrementing the subband number sb.

As can be seen from the preceding discussion, the present embodiment greatly reduces the computational burden because it quantizes each transform coefficient only once, as well as eliminating the need for dequantization or calculation of quantization error power. Also, as discussed in the flowchart of FIGS. 13 and 14, the present embodiment advances processing from lower subbands to higher subbands until the number of coded bits reaches a given limit. This limit is actually determined from the available bit space in the bit reservoir in addition to a specified bitrate. It is not always necessary to calculate perceptual entropy or the like. The present embodiment therefore assigns more bits to wide-band frames and less bits to narrow-band frames. The resulting bit distribution gives the same effect as that provided by conventional coding devices that assign bits in accordance with the magnitude of perceptual entropy. The present embodiment, however, simplifies computational processes and reduces the requirements for program memory and processor power.

The present embodiment has the advantage over conventional techniques in terms of processing speeds. To realize a realtime encoder, conventional audio compression algorithms require an embedded processor that can operate at about 3 GHz. In contrast, the algorithm of the present embodiment enables even a 60-MHz class processor to serve as a realtime encoder. The applicant of the present invention has actually measured the computational load and observed its reduction to 1/50 or below.

MPEG2-AAC Encoder

Figure 15:
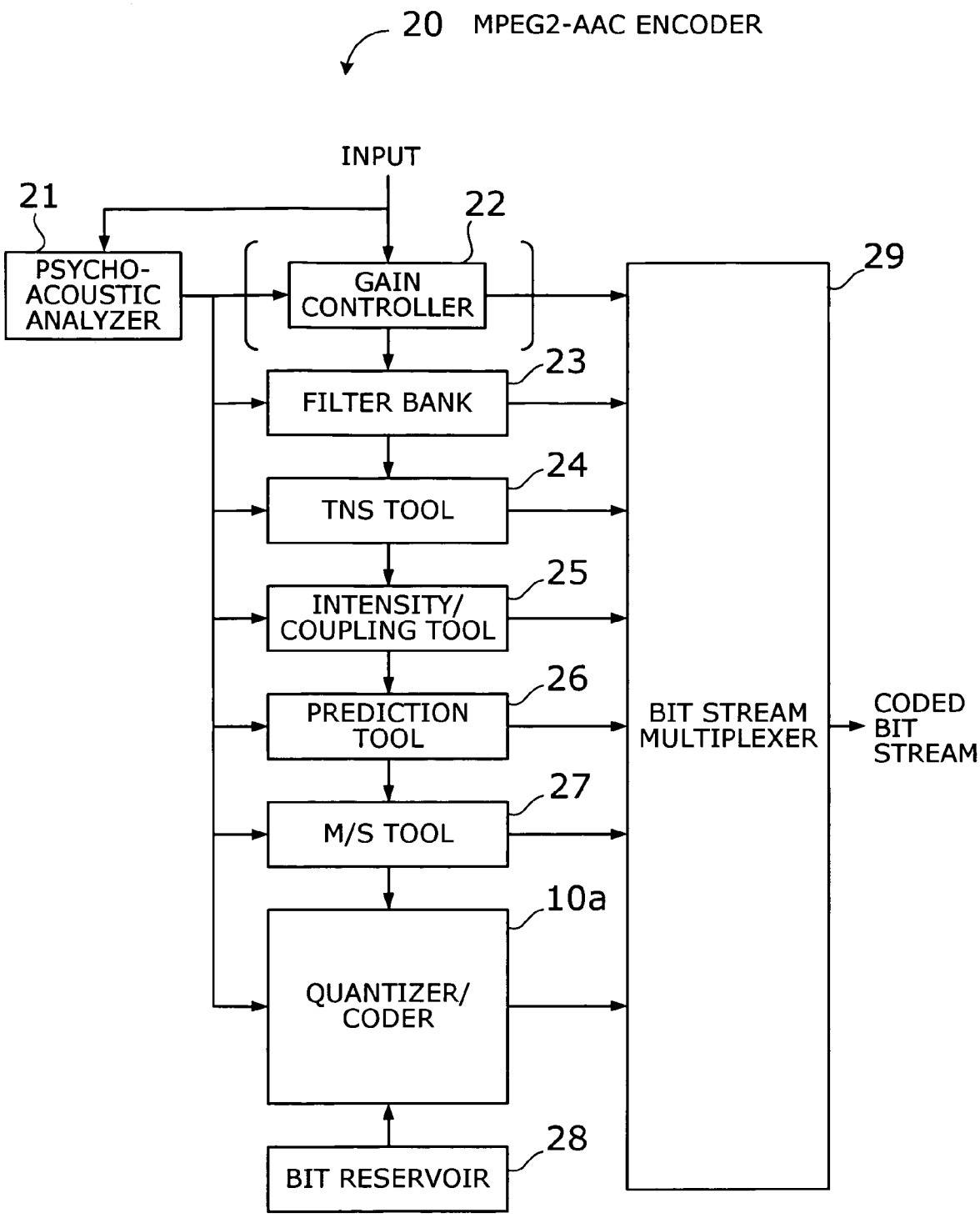
FIG. 15 shows the structure of an MPEG2-AAC encoder.

This section describes an MPEG2-AAC encoder in which the audio coding device 10 of the present embodiment is implemented. FIG. 15 is a block diagram of an MPEG2-AAC encoder of the invention. This MPEG2-AAC encoder 20 has the following elements: a psycho-acoustic analyzer 21, a gain controller 22, a filter bank 23, a temporal noise shaping (TNS) tool 24, an intensity/coupling tool 25, a prediction tool 26, a middle/side (M/S) tool 27, a quantizer/coder 10*a*, a bit reservoir 28, and a bit stream multiplexer 29. Although not explicitly shown, the quantizer/coder 10*a* actually contains a quantizer 13, scalefactor calculator 14, and coder 15 as explained in FIG. 1.

The AAC algorithm offers three profiles with different complexities and structures. The following explanation assumes Main Profile (MP), which is supposed to deliver the best audio quality.

The samples of a given audio input signal are divided into blocks. Each block, including a predetermined number of samples, is processed as a single frame. The psycho-acoustic analyzer 21 applies Fourier transform to an input frame, thereby producing a frequency spectrum. Based on this frequency spectrum of the given frame, the psycho-acoustic analyzer 21 calculates masking power thresholds and perceptual entropy parameters for that frame, considering masking effects of the human auditory system.

The gain controller 22 is a tool used only in one profile named "Scalable Sampling Rate" (SSR). With its band-splitting filters, the gain controller 22 divides a given time-domain signal into four bands and controls the gain of upper three bands. The filter bank 23 serves as an MDCT operator, which applies MDCT processing to the given time-domain signal, thus producing transform coefficients. The TNS tool 24 processes the transform coefficients with a linear prediction filtering technique, manipulating those coefficients as if they were time-domain signals. The TNS processing shifts the distribution of quantization noise toward a region where the signal strength is high. This feature effectively reduces quantization noise produced as a result of inverse MDCT in a decoder. The gain controller 22 and TNS tool 24 are effective for coding of sharp sound signals produced by percussion instruments, for example.

The intensity/coupling tool 25 and M/S tool 27 are tools used to improve the coding efficiency when there are two or more channels as in the case of stereo audio signals, taking advantage of inter-channel dependencies of such signals. Intensity stereo encoding codes the ratio between the sum signals of left and right channel signals and their power. Coupling channel encoding codes a coupling channel to localize a sound image in the background sound field. The M/S tool 27 selects one of two coding schemes for each subband. One encodes left (L) and right (R) channel signals, and the other encodes sum (L+R) and difference (L−R) signals.

The prediction tool 26 is only for the Main Profile. For each given transform coefficient, the prediction tool 26 refers back to transform coefficients of the past two frames in order to predict the present transform coefficient in question, thus calculating its prediction error. An extremely large prediction gain, as well as minimization of power (variance) of transform coefficients, will be achieved particularly in the case where the input signal comes from a stationary sound source. A source signal with a smaller variance can be compressed more effectively with fewer bits as long as a certain level of quantization noise power is allowed.

The transform coefficients are supplied from the above tools to the quantizer/coder 10*a*, the key element of the present embodiment. The quantizer/coder 10*a* offers a single-pass process of quantization and encoding for a set of transform coefficients of each subband. See earlier sections for the detailed operation of the quantizer/coder 10*a*. Unlike this quantizer/coder 10*a*, conventional AAC encoders include a functional block to execute iteration loops for quantization and Huffman encoding, which is not efficient because it requires repetitions until the resulting amount of coded bits falls below a specified data size of each frame.

The bit reservoir 28 serves as a buffer for storing data bits temporarily during a Huffman encoding process to enable flexible allocation of frame bit space in an adaptive manner. It is possible to implement a pseudo variable bit rate using this bit reservoir 28. The bit stream multiplexer 29 combines coded bits from those coding tools to multiplex them into a single AAC bit stream for distribution over a transmission line.

CONCLUSION

As can be seen from the above explanation, the audio coding device according to the present invention is designed to estimate quantization noise from a representative value selected from transform coefficients of each subband, and calculate in an approximative way a quantization step size for each subband from the estimated quantization noise, as well as from a masking power threshold that is determined from psycho-acoustic characteristics of the human auditory system. With the determined quantization step sizes, it quantizes transform coefficients, as well as calculates a common scalefactor and individual scalefactors for each subband, before they are encoded together with the transform coefficients into an output bitstream.

The conventional techniques take a trial-and-error approach to find an appropriate set of scalefactors that satisfies the requirement of masking power thresholds. By contrast, the present invention achieves the purpose with only a single pass of processing, greatly reducing the amount of computational load. This reduction will also contribute to the realization of small, low-cost audio coding devices.

The preceding sections have explained an MPEG2-AAC encoder as an application of the present invention. The present invention should not be limited to that specific application, but it can also be applied to a wide range of audio encoders including MPEG4-AAC encoders and MP3 encoders.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An audio coding device for encoding an audio signal, comprising:

a spatial transform unit that subjects samples of a given audio signal to a spatial transform process, thereby producing transform coefficients grouped into a plurality of subbands according to frequency ranges thereof;

a quantization step size calculator that estimates quantization noise from a representative value selected out of the transform coefficients of each subband, and calculates in an approximative way a quantization step size for each subband from the estimated quantization noise, as well as from a masking power threshold that is determined from psycho-acoustic characteristics;

a quantizer that quantizes the transform coefficients, based on the calculated quantization step sizes, so as to produce quantized values of the transform coefficients;

a scalefactor calculator that calculates a common scalefactor and an individual scalefactor for each subband from the quantization step sizes, the common scalefactor serving as an offset applicable to an entire frame of the audio signal; and a coder that encodes at least one of the quantized values, the common scalefactor, and the individual scalefactors, wherein the quantization step size calculator estimates the quantization noise for nonlinear compression by calculating first an approximate quantization noise of the selected representative value and then multiplying the approximate quantization noise by a correction coefficient.

2. The audio coding device according to claim 1, wherein:

the quantization of the selected representative value Xa of the transform coefficients is expressed as $$|xa|\hat{}(3/4)*2\hat{}(-3q/16)-0.0946$$

where q represents the quantization step size; and the quantization step size calculator calculates the approximate quantization noise Na of |Xa↑^(¾), the correction coefficient r, and the quantization noise N as follows:

$$Na=2\hat{}(3q/16)/2^n \text{ where } n=0,1,2,\ldots$$

$$r=|Xa|/|Xa|\hat{}(3/4)=|Xa|\hat{}(1/4)$$

$$N=Na*r=2\hat{}((3q/16)-n)*|Xa|\hat{}(1/4).$$

3. The audio coding device according to claim 1, wherein the quantization step size calculator calculates the quantization step size q in an approximative way by using a formula of:

$$q=[\log_2\{M\hat{}(1/2)*|Xa|\hat{}(-1/4)\}+n]*16/3$$

where n is an integer of 0, 1, 2, and so on, M represents the masking power threshold, and Xa represents the representative value of the transform coefficients.

4. The audio coding device according to claim 1, wherein:

the scalefactor calculator chooses a maximum value of the quantization step size of each subband as a common scalefactor; and the scalefactor calculator calculates the individual scalefactor of each subband by subtracting the quantization step size of that subband from the common scalefactor.

5. The audio coding device according to claim 1, wherein the coder advances encoding tasks thereof from lower subbands to higher subbands until the number of coded bits reaches a given limit.

6. An MPEG-AAC encoder for coding multi-channel audio signals, comprising:

(a) a quantization/coding controller, comprising:

a psycho-acoustic analyzer that calculates masking power thresholds by analyzing samples of a given audio signal with a Fourier transform technique, a modified discrete cosine transform (MDCT) unit that subjects the samples to an MDCT process, thereby producing transform coefficients that are grouped into a plurality of subbands according to frequency ranges thereof, a quantization step size calculator that estimates quantization noise from a representative value selected out of the transform coefficients of each subband, and calculates in an approximative way a quantization step size for each subband from the estimated quantization noise, as well as from a masking power threshold that is determined from psycho-acoustic characteristics, a quantizer that quantizes the transform coefficients, based on the calculated quantization step sizes, so as to produce quantized values of the transform coefficients, a scalefactor calculator that calculates a common scalefactor and an individual scalefactor for each subband from the quantization step sizes, the common scalefactor serving as an offset applicable to an entire frame of the audio signal, and a coder that encodes at least one of the quantized values, the common scalefactor, and the individual scalefactors; and (b) a bit reservoir that serves as a buffer for temporarily storing data bits during a Huffman encoding process to enable flexible allocation of frame bit space in an adaptive manner, wherein the quantization step size calculator estimates the quantization noise for nonlinear compression by calculating first an approximate quantization noise of the selected representative value and then multiplying the approximate quantization noise by a correction coefficient.

7. The MPEG-AAC encoder according to claim 6, wherein:

the quantization of the selected representative value Xa of the transform coefficients is expressed as $$|xa|^{(3/4)}*2^{(-3q/16)}-0.0946$$

where q represents the quantization step size;

the quantization step size calculator calculates the approximate quantization noise Na of $|Xa|^{(3/4)}$, the correction coefficient r, and the quantization noise N as $$Na=2^{(3q/16)}/2^n \text{ where } n=0,1,2,\ldots$$

$$r=|Xa|/|Xa|^{(3/4)}=|Xa|^{(1/4)}$$

$$N=Na*r=2^{((3q/16)-n)}*|Xa|^{(1/4)}.$$

8. The MPEG-AAC encoder according to claim 6, wherein the quantization step size calculator calculates the quantization step size q in an approximative way by using a formula of:

$$q=[\log_2\{MA(1/2)*|Xa|^{(-1/4)}\}+nJ*16/3$$

where n is an integer of 0, 1, 2, and so on, M represents the masking power threshold, and Xa represents the representative value of the transform coefficients.

9. The MPEG-AAC encoder according to claim 6, wherein:

the scalefactor calculator chooses a maximum value of the quantization step size of each subband as a common scalefactor; and the scalefactor calculator calculates the individual scalefactor of each subband by subtracting the quantization step size of that subband from the common scalefactor.

10. The MPEG-AAC encoder according to claim 6, wherein the coder advances encoding tasks thereof from lower subbands to higher subbands until the number of coded bits reaches a given limit.

11. A method of calculating individual and common scalefactors to determine quantization step sizes for use in quantization of an audio signal, the method comprising:

subjecting samples of a given audio signal to a spatial transform process, thereby producing transform coefficients grouped into a plurality of subbands according to frequency ranges thereof;

a quantization step size calculator, performing:

estimating quantization noise from a representative value selected out of the transform coefficients of each subband;

calculating in an approximative way a quantization step size for each subband from the estimated quantization noise, as well as from a masking power threshold that is determined from psycho-acoustic characteristics;

choosing a maximum value of the quantization step size of each subband as a common scalefactor that gives an offset of an entire frame of the audio signal; and calculating an individual scalefactor of each subband by subtracting the quantization step size of that subband from the common scalefactor, wherein the quantization step size calculator estimates the quantization noise for nonlinear compression by calculating first an approximate quantization noise of the selected representative value and then multiplying the approximate quantization noise by a correction coefficient.

12. The method according to claim 11, wherein:

the quantization of the selected representative value Xa of the transform coefficients is expressed as $$|xa|^{(3/4)}*2^{(-3q/16)}-0.0946$$

where q represents the quantization step size; and the quantization step size calculator calculates the approximate quantization noise Na of $|Xa|^{(3/4)}$, the correction coefficient r, and the quantization noise N as follows:

$$Na=2^{(3q/16)}/2^n \text{ where } n=0,1,2,\ldots$$

$$r=|Xa|/|Xa|^{(3/4)}=|Xa|^{(1/4)}$$

$$N=Na*r=2^{((3q/16)-n)}*|Xa|^{(1/4)}.$$

13. The method according to claim 11, wherein the quantization step size calculator calculates the quantization step size q in an approximative way by using a formula of:

$$q=[\log_2\{MA(1/2)*|Xa|^{(-1/4)}\}+nJ*16/3$$

where n is an integer of 0, 1, 2, and so on, M represents the masking power threshold, and Xa represents the representative value of the transform coefficients.

* * * * *